US005120980A

United States Patent [19]

Fontaine

[11] Patent Number: 5,120,980

[45] Date of Patent: Jun. 9, 1992

[54] SEAT CUSHION SWITCH WITH DELAY CIRCUIT

[75] Inventor: William G. Fontaine, Pompano Beach, Fla.

[73] Assignee: Fontaine Brake Company, Deerfield Beach, Fla.

[21] Appl. No.: 520,460

[22] Filed: May 8, 1990

[51] Int. Cl.[5] ..... H01H 3/14

[52] U.S. Cl. ..... 307/16.1; 200/85 A; 307/116; 307/141.4; 340/529; 340/667

[58] Field of Search ..... 200/85 R, 85 A, 86 R; 307/9.1, 10.1, 39, 116, 119, 139, 140, 141, 141.4, 142; 361/170, 195-202; 340/436, 438, 457.1, 573, 665-667, 686, 541, 529; 180/273; 297/452

[56] References Cited

U.S. PATENT DOCUMENTS

| | | | |
|---|---|---|---|
| 3,487,451 | 12/1969 | Fontaine | 303/19 |
| 3,704,352 | 11/1972 | Fontaine | 200/85 R |
| 3,718,791 | 2/1973 | Szablowski | 200/85 A |
| 3,860,773 | 1/1975 | Fontaine | 200/85 A |
| 3,893,698 | 7/1975 | Fontaine | 303/89 |
| 4,137,116 | 1/1979 | Miller | 156/269 |
| 4,661,664 | 4/1987 | Miller | 200/86 R |
| 4,844,196 | 7/1989 | Clevenger, Jr. et al. | 180/273 |

*Primary Examiner*—A. D. Pellinen
*Assistant Examiner*—David Osborn
*Attorney, Agent, or Firm*—Oltman and Flynn

[57] ABSTRACT

A general purpose time delay weight activated switch is disclosed. A foam seat cushion contains wire mesh electrical switch closing contacts. Sitting or rising from the cushion opens and closes the switch. A solid state adjustable timer is also imbedded in the cushion, or adjacent to the cushion. Its purpose is to delay the opening of the switch several seconds. An ideal application for the device is to automaticlly lock an emergency brake in a delivery van. The driver leaving the parked vehicle automatically locks the parking brake or vehicle brakes when leaving the vehicle when the present invention is combined with a parking brake or vehicle brake locking means. The invention's delay circuit allows the driver to bounce up and down on a bumpy road without setting off the switch. Other uses for this special purpose seat cushion include railroad, farm equipment, industrial and power boat safety systems.

5 Claims, 2 Drawing Sheets

FIG. 1
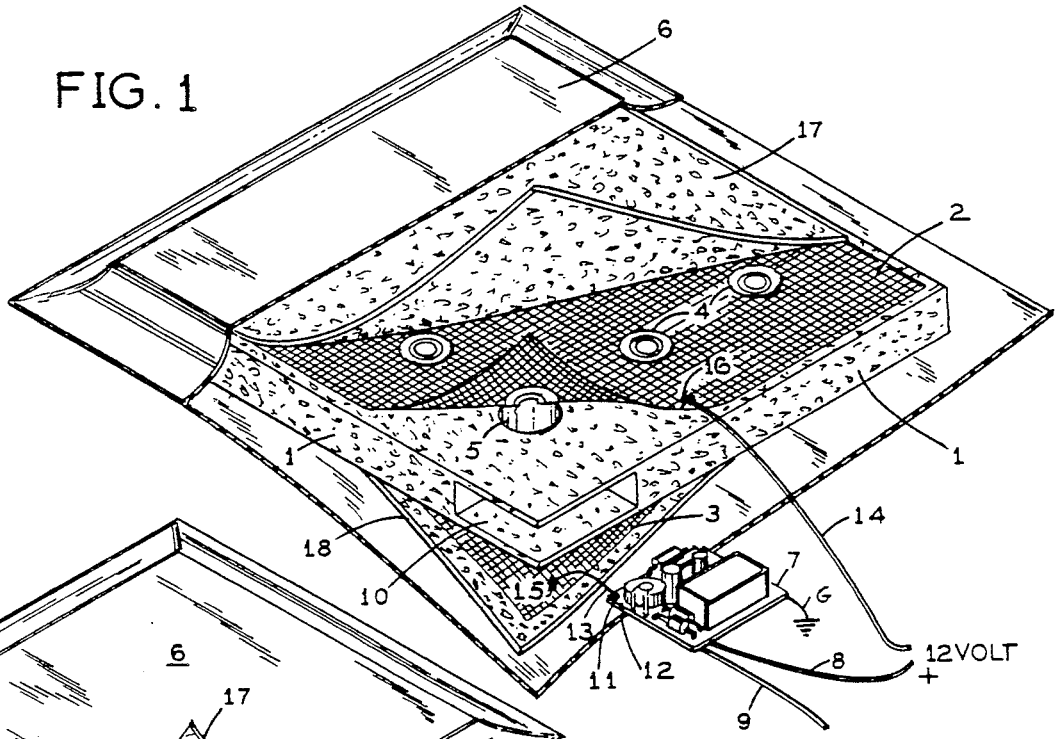
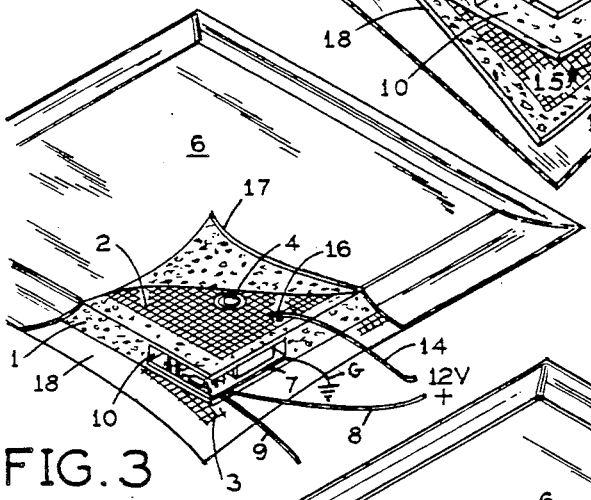
FIG. 3
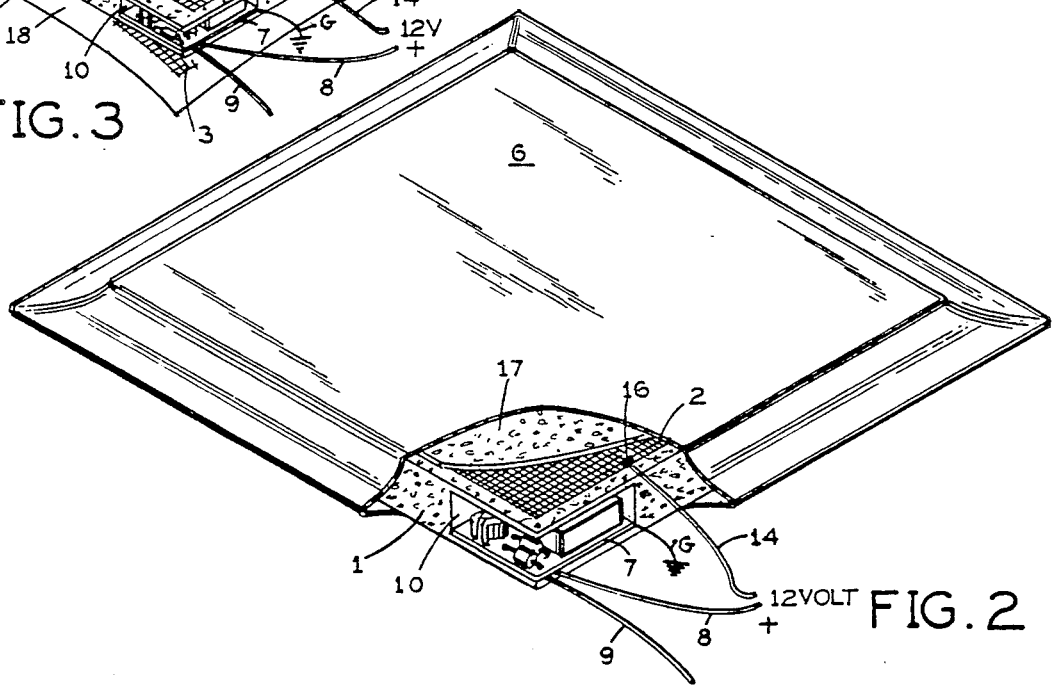
FIG. 2

SEAT CUSHION SWITCH WITH DELAY CIRCUIT

SUMMARY OF THE INVENTION

This invention combines a weight activated seat cushion switch with an electronic delay circuit. The device is a self-contained plastic covered seat cushion with up to three wires protruding from one edge. It fits on any seat suited for humans. The wires can be connected to any safety or convenience device which requires activation by sitting on or rising from the seat.

A thin plastic sheet encloses a foam rubber and wire mesh sandwich type switch. Two layers of thin foam rubber line the outside of the cushion. Underneath lie two sections of electrically conductive wire mesh separated by a relatively thick insulating layer of foam rubber. Each layer of wire mesh holds several contact washers. These washers pass through matching holes in the central insulating foam rubber pad. Matching contact can make electrical contact in between the holes when the insulating layer is compressed by weight. Normally the washers don't touch, leaving an open circuit between the positive and megative lead wires. Sitting on the cushion compresses the central insulating foam pad thus allowing one or more of the washers to make contact with the opposing washer.

One lead wire passes through a solid state adjustable delay timer circuit board before exiting the cushion. This circuit board uses transistors, resistors and relays to delay the opening of the circuit between the positive and negative lead wires after the circuit is closed by a person sitting on the cushion. A charged capacitor discharging at an adjustable rate activates an electronic gate which charges a coil thus opening a relay on the lead wire circuit.

The primary object of this invention is to provide a novel composite switch activating seat cushion ideally suited for vehicle safety applications.

A secondary object is to provide an inexpensive yet rugged design to allow for weight to bounce up and down on the device for prolonged periods of time without disturbing the functionality of the cushion.

Other object of this invention will appear from the following description and appended claims, reference being had to the accompanying drawings forming a part of this specification wherein like reference characters designate corresponding parts in the several views.

DESCRIPTION OF THE DRAWINGS

FIG. 1 is a top side cutaway view of the cushion showing all the major parts with the delay circuit adjacent to its mounting position;

FIG. 2 is the same view as FIG. 1 with the delay circuit properly mounted in the cushion;

FIG. 3 is the same view as FIG. 2 where the cushion has not been inserted into its plastic wrapper;

Figure 4:
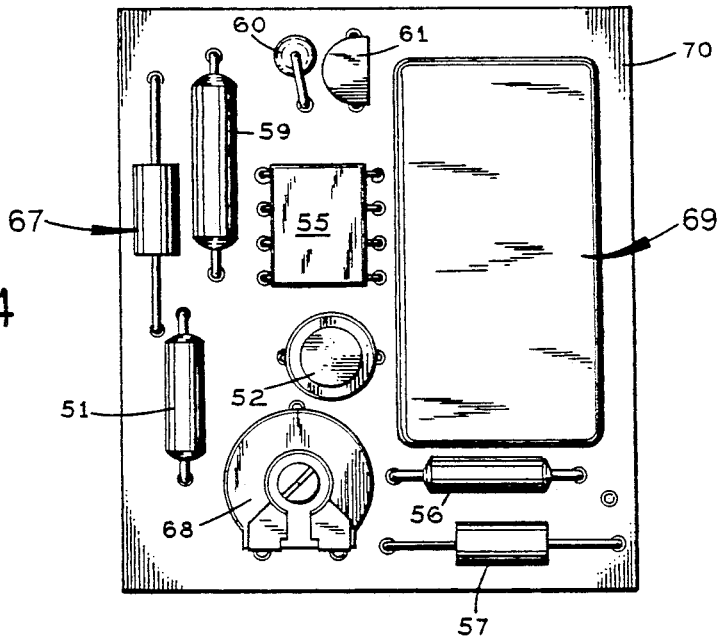
FIG. 4 is a top down view of the delay circuit showing the solid state components.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Referring to FIG. 1, a resilient compressible apertured separator 1 separates two wire mesh contact sheets 2 and 3 in which conductive contacts 4 are mounted on several opposing locations on sheets 2 and 3. Holes 5 allow opposing contacts 4 which are preferably washers, to touch when separator 1 is compressed. In normal operation this would occur when a person sits on the device. Contacts 4 are electrically connected to contact sheets 2 and 3. Delay circuit 7 normally fits into slot 10. Lead wires 8 and 9 and G are normally connected to whatever activating device this invention triggers (not shown). Resilient layers 17 and 18 protect contact sheets 2 and 3. Plastic cover 6 provides a protective outer cover for the device of the invention.

During operation twelve volts of DC electric power is applied across lead wires 8 and 14 by the activating device this invention triggers (not shown). Lead wire G attaches to ground. A typical application using the present invention would be a vehicle emergency brake system configured to apply the emergency brakes when the driver lifted his weight off the invention for more than a few seconds. Typically this total system adds a measure of safety to a delivery truck operation requiring numerous park and stop maneuvers while the vehicle is running.

While contact is sensed between contact sheets 2 and 3 by the delay circuit 7, a direct electic path between leads 8 and 9 is provided by delay circuit 7. When contact stops between contact sheets 2 and 3, delay circuit 7 electronically delays opening the electric path between lead 8 and 9 for an adjustable period of time, usually 3-7 seconds.

Contact points 15 and 16 and wires 13 and 14 provide an electric path from sheets 2 and 3 through the delay circuit 7 via input terminal 11.

FIG. 2 shows delay circuit 7 in position in slot 10. Lead wires 8, 9 and G normally protrude through plastic cover 6. Lead wire 14 electrically joins wire 8 before exiting cover 6.

FIG. 3 shows the invention without the plastic cover 6. Wire 14 is shown while wire 13 is hidden beneath delay circuit 7 (see FIG. 2). Contacts 4 are behind delay circuit 7 and do not touch delay circuit 7. Layers 17 and 18 are double sided adhesive material.

Figure 5:
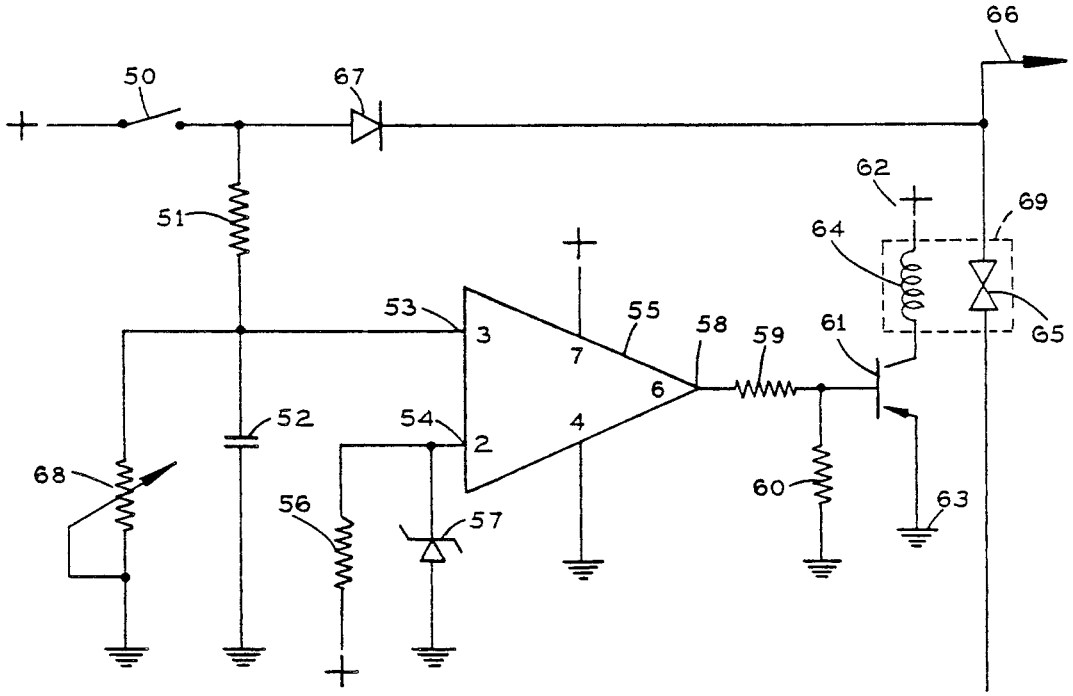
FIG. 5 is a schematic diagram of the delay circuit.

Referring next to FIG. 5, the circuit of the delay circuit 7 is shown. All+symbols mean a twelve volt DC power source is present. Normally when power is on the seat switch 50 is closed and capacitor 52 is charged through resistor 51. At the same time, reference point 53 serves as a comparator 55 input leg carrying an input signal which comparator 55 compares against reference point 54, the other input leg into comparator 55. Resistor 56 in series with zener 57 creates a reference voltage at point 54 which is lower than 53.

Positive output from comparator 55 is at point 58 which drops across resistors 59 and 60 thus biasing (activating) transistor 61 to the ON position. When transistor 61 is ON a current is allowed to flow from power source 62 through coil 64 to ground 63. When coil 64 receives current, it inductively holds contacts 65 closed. In this condition, reference point 66 maintains a twelve volt charge to any external device (not show). Diode 67 is in a conducting state during the above conditions.

When seat switch 50 opens, power is removed from resistor 51 and capacitor 52 discharges through variable resistor 68. When reference point 53 becomes lower than reference point 54, the output of comparator 55 drops to zero. Transistor 61 then switches to the OFF position stopping current through coil 64 thus causing contact 65 to open in a delayed time after seat switch 50 was opened. The discharge time of capacitor 52 as controlled by the value of resistor 68 controls the time delay of contact 65 opening. Coil 64 and contact 65 form an electronic relay 69.

FIG. 4 shows one physical embodiment of the components described in FIG. 5 mounted on solid circuit board

I claim:

1. A weight activated seat cushion electric switch comprising:

a resilient compressible apertured separator having a slot;

an electrically conductive mat on either side of said separator cooperating with said separator wherein pushing on said mats creates electric contact between said mats;

a protective sheet covering both said conductive mats;

an electronic delay circuit fitted into said slot;

said electronic delay circuit further comprising an electric connection to at least one conductive mat;

said elecronic delay circuit functioning to provide a delayed open circuit signal after said conductive mats are pushed apart by said resilient compressible apertured separator.

2. The switch of claim 1 further comprising an outer protective covering functioning to enclose said separator, said conductive mats, said protective sheets and said delay circuit.

3. The switch of claim 1 wherein said electrically conductive mats have electric contact washers opposing said apertures.

4. The switch of claim 1, wherein said electronic delay circuit further comprises a capacitor, a variable resistor, a relay and a comparator having a plurality of input legs connected whereby a drop in voltage across a first input leg of said comparator caused by the opening of said cushion electric switch causes said capacitor to discharge simultaneously into said first input leg of said comparator and said variable resistor to ground, wherein said comparator upon sensing an input imbalance flips said relay to an open position at a variable time lag after said seat cushion electric switch opens, wherein said variable time lag is dependent on the value of said variable resistor.

5. A weight activated seat cushion electric switch comprising:

a resilient compressible apertured separator having a slot in one corner;

an electrically conductive mat on either side of said separator cooperating with said separator wherein pushing on said mats creates electric contact between said mats;

a protective sheet covering both said conductive mats;

an electronic delay circuit fitted into said slot;

said electronic delay circuit further comprising an electric connection to one conductive mat;

said electronic delay circuit functioning to provide a delayed open circuit signal after said conductive mats are pushed apart by said resilient compressible apertured separator.

* * * * *